United States Patent [19]

Foster

[11] Patent Number: 4,731,883

[45] Date of Patent: Mar. 22, 1988

[54] GARMENT VENTILATION APERTURES WITH COVER FLAP

[76] Inventor: Ronald W. Foster, 35322 Deerpath Rd., Batavia, Ill. 60510

[21] Appl. No.: 2,943

[22] Filed: Jan. 13, 1987

[51] Int. Cl.[4] ..... A41D 27/28

[52] U.S. Cl. ..... 2/69; 2/DIG. 1; 2/247

[58] Field of Search ..... 2/69, 88, 84, 247, DIG. 1; 135/91, 93, 94

[56] References Cited

U.S. PATENT DOCUMENTS

| | | | |
|---|---|---|---|
| 317,711 | 5/1885 | Brinkmann . | |
| 1,381,373 | 6/1921 | Waterman . | |
| 3,213,465 | 10/1962 | Ludwikowski | 2/87 |
| 3,228,821 | 1/1966 | Trope | 161/112 |
| 4,576,087 | 3/1986 | Wolfe | 2/87 X |
| 4,619,004 | 10/1986 | Won | 2/227 |

FOREIGN PATENT DOCUMENTS

| | | | |
|---|---|---|---|
| 527877 | 6/1955 | Fed. Rep. of Germany | 2/DIG. 1 |
| 16900 | of 1911 | United Kingdom | 2/DIG. 1 |

*Primary Examiner*—Werner H. Schroeder

*Attorney, Agent, or Firm*—Fleit, Jacobson, Cohn & Price

[57] ABSTRACT

An outer rain wear garment is provided with improved ventilation in the form of a mesh insert under a pocket flap of the garment. The flap can be secured to the garment either in a regular pocket-closing position effectively blocking the mesh or in an arched position providing a tunnel over the mesh for improved air circulation through the mesh.

7 Claims, 4 Drawing Figures

GARMENT VENTILATION APERTURES WITH COVER FLAP

BACKGROUND OF THE INVENTION

This invention relates to the ventilation of outer garments, particularly garments such as rainwear garments which commonly are made of non-breathable materials such as rubberized fabrics; (Nylon, and the like.)

It is common practice with outer garments made of non-breathable fabrics to provide some form of ventilation apertures cut in the fabric. Such apertures, however, if provided in sufficient numbers to give the garment adequate ventilation, may tend to defeat the very purpose of the garment, notably in providing a waterproofing facility, and the provision of multiple apertures may also be unsightly.

Examples of previously proposed garment ventilation systems may be seen in the following U.S. Pat. Nos.:

317,711; May 12, 1885
1,381,323; June 14, 1921
3,213,465; Oct. 26, 1965
3,228,821; Jan. 11, 1966
4,576,087; Mar. 18, 1986

SUMMARY OF THE INVENTION

It is an object of the invention to provide a novel form of garment ventilation system which effectively camouflages the ventilation means and enables relatively large and effective ventilation areas to be provided at locations on garments not generally associated with the provision of ventilation means.

It is a further object of the invention to provide garment ventilation means under a garment flap, such as a pocket flap, commonly a breast pocket flap, the flap being provided with attachment means for releasably securing same to a portion of the garment thereunder in an arched configuration of the flap providing a form of access duct or tunnel for improving air circulation to and through the ventilation means.

Thus, the ventilation means, which may be in the form of apertures in the garment fabric under the flap or in the form of a mesh fabric insert, are generally obscured from view by the flap and yet, when required, can provide improved air circulation and ventilation by moving the flap from a normal flap position in which it substantially blocks the ventilation means into the arched configuration.

It is understood that the invention is primarily though not exclusively intended for use with outer garments, particularly rain wear, made of non-breathable fabrics.

These together with other objects and advantages which will become subsequently apparent reside in the details of construction and operation as more fully hereinafter described and claimed, reference being had to the accompanying drawings forming a part hereof, wherein like numerals refer to like parts throughout.

Figure 1:
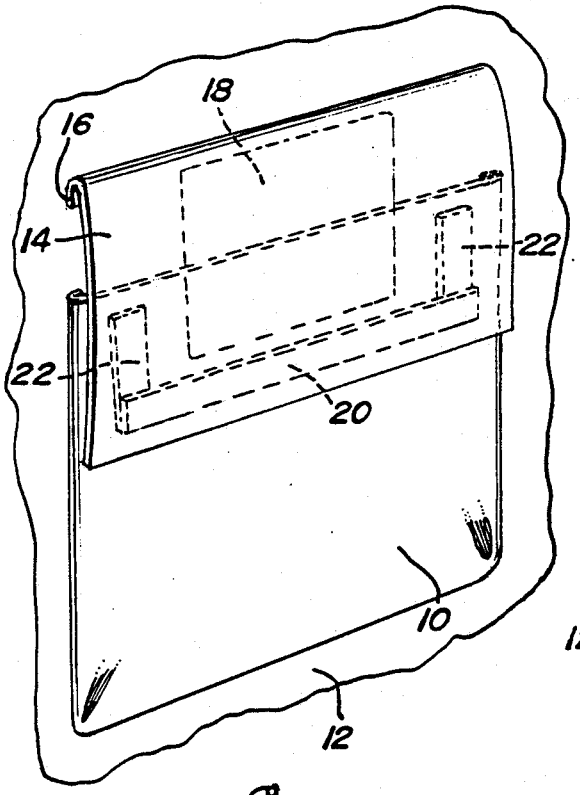
FIG. 1 is a perspective view of a breast pocket structure of an outer garment with a pocket flap shown in the regular pocket closing position.

Fiqure 4 is an elevational view of the structure with the flap raised to show the other components of the structure.

DESCRIPTION OF THE PREFERRED EMBODIMENT

An outer garment, such as a waterproof jacket or the like, has a breast pocket 10 secured to a body panel 12 of the garment in conventional manner, and a pocket flap 14 for closing the pocket. The body panel is of a generally non-breathable material such as a rubberized Nylon fabric, or the like. Edge portion 16 of flap 14 is secured, as by sewing to body panel 12 at a location which is spaced somewhat, for example, about a ½ inch, above the top of pocket 10.

In order to ventilate the garment, at least in part, the body panel 12 is provided with a cutout section into which an insert panel 18 of mesh or like breathable fabric is sewn to provide a ventilation means. The panel may occupy a substantial part of the area between the edge portion 16 of the flap and the top of the pocket, and in the illustrated embodiment actually extends to below the top of the pocket. (In place of the insert panel 18, the body panel 12 could alternatively be provided with an array of ventilation apertures over a similar area.)

Figure 2:
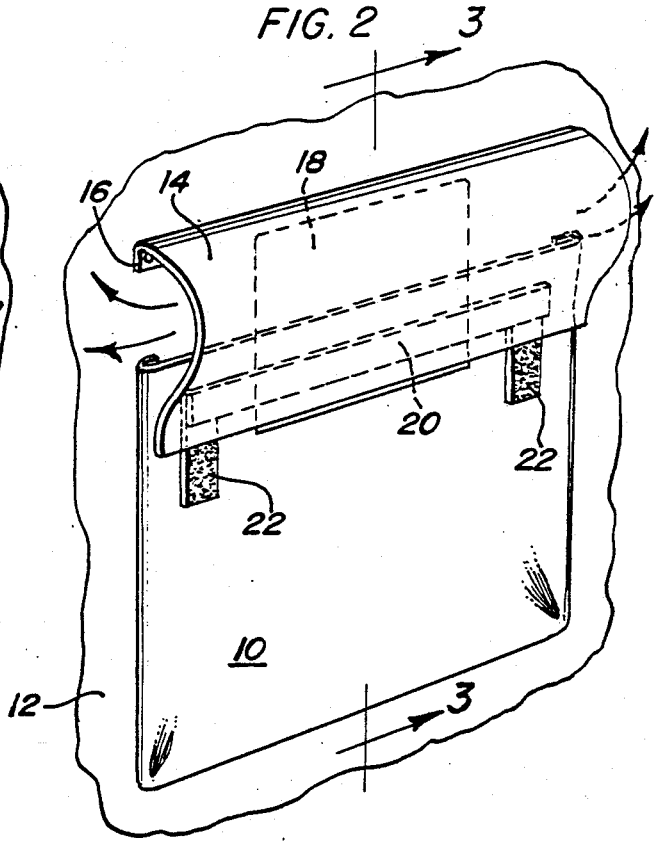
FIG. 2 is a view similar to FIG. 1 with the flap moved to a ventilating position.
Figure 3:
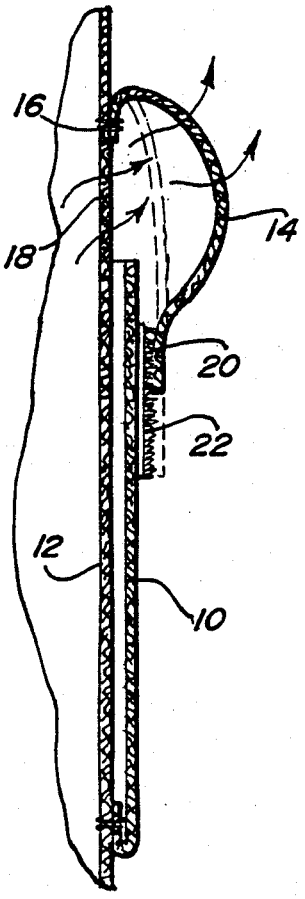
FIG. 3 is a sectional view on line 3—3 of FIG. 2.
Figure 4:
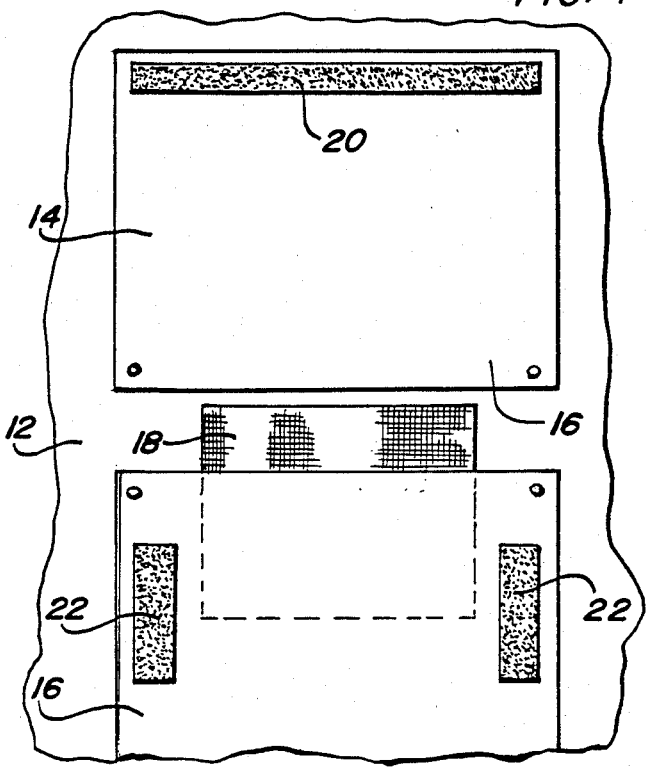

The lower inner edge portion of flap 14 is provided with a first horizontal Velcro-like strip 20 and the outside of pocket 10 is provided with complementary vertical Velcro-like strips 22. The length of strips 22 is such as to allow the flap 12 to be secured to the outside of the pocket, via the respective Velcro-type strips in a regular pocket closing position as shown in FIG. 1 wherein the flap is substantially flat against the garment and the ventilation insert 18 is effectively blocked. Alternatively, the flap may be secured in a ventilating position, as shown in FIGS. 2 and 3, wherein thc flap is somewhat arched and provides a tunnel outside of insert 18 which allows for air circulation to and from the insert for improved ventilation without exposing the ventilation insert to view. It will be understood that attachment means other than Velcro-type strips can be used for releasably securing the flap in its respective positions. Also, the ventilation means may be provided in association with one or more pockets in a particular garment. Furthermore, it is not essential that the ventilation means-obscuring flap necessarily need be associated with a garment pocket.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A garment having a body panel, a flap on an outer surface of the body panel, ventilation means in the body panel under the flap, and attachment means for releasably and selectively securing the flap to the garment in a first position wherein the flap is substantially flat against the garment effectively blocking the ventilation means and a second position wherein the flap is arched over and concealing the ventilation means to provide a tunnel for promoting air circulation through the ventilation means.

2. The invention of claim 1 wherein the ventilation means is an insert of perforated fabric in the body panel.

3. The invention of claim 1 wherein the ventilation means comprises aperture means in the body panel.

4. The invention of claim 1 wherein the flap is a breast pocket flap.

5. The invention of claim 1 wherein the attachment means comprises Velcro-type attachment means on the flap and complementary elongate Velcro-type attachment means on the garment.

6. The invention of claim 5 wherein the attachment means comprises a first Velcro-type strip on the flap and a pair of elongate second Velcro-type strips on the garment perpendicular to and at opposite ends of the first strip.

7. In combination with a panel constructed of material substantially impervious to air, said panel having a finite area constructed for passage of air through the panel, a closure member selectively covering said area to prevent passage of air therethrough, the improvement comprising said closure member being conencted to the panel along one edge thereof with the closure member completely covering said area and including a free edge oposite to the connected edge, said free edge extending beyond said area, said closure member being constructed in a manner enabling it to be formed into a tunnel having an arch-like configuration overlying and concealing said area but enabling air flow through the area and through the open ends of the tunnel, fastening means detachably securing the free edge of the closure member to the panel in spaced relation to an adjacent edge of said area to secure the closure member in substantially flat condition thereby forming a closure for said area and concealing said area, said fastening means also securing the free edge of the closure member to the panel at a point in a position closer to the adjacent edge of said area with the closure member being formed in arch-like configuration while maintaining said area in the panel concealed and permitting air flow through said area of the panel and through the ends of the tunnel formed by the arch-like configuration of the closure member.

* * * * *